US006792776B2

(12) United States Patent
Bruntz et al.

(10) Patent No.: US 6,792,776 B2
(45) Date of Patent: Sep. 21, 2004

(54) HIGH EFFICIENCY WATER VALVE FOR WASHING APPLIANCE

(75) Inventors: Jordan S. Bruntz, Baxter, IA (US); Scott A. Merkle, Newton, IA (US)

(73) Assignee: Maytag Corporation, Newton, IA (US)

( * ) Notice: Subject to any disclaimer, the term of this patent is extended or adjusted under 35 U.S.C. 154(b) by 323 days.

(21) Appl. No.: 10/056,864

(22) Filed: Oct. 26, 2001

(65) Prior Publication Data

US 2003/0079507 A1 May 1, 2003

(51) Int. Cl.[7] ..... D06F 33/00; E03B 1/00

(52) U.S. Cl. ..... 68/12.03; 68/12.23; 68/207; 137/607

(58) Field of Search ..... 68/12.03, 12.23, 68/207; 137/606, 607; 134/57 D, 58 D

(56) References Cited

U.S. PATENT DOCUMENTS

| | | | | |
|---|---|---|---|---|
| 3,591,130 A | * | 7/1971 | McCarty | 251/129.15 |
| 4,267,711 A | | 5/1981 | Kolze | 68/12.21 |
| 4,270,570 A | | 6/1981 | Kolze | 137/597 |
| 4,290,450 A | | 9/1981 | Swanson | 137/606 |
| 4,503,575 A | * | 3/1985 | Knoop et al. | 8/158 |
| 5,255,844 A | | 10/1993 | Miller et al. | 236/12.12 |
| 5,289,811 A | | 3/1994 | Covert et al. | 125/520 |
| 5,425,255 A | | 6/1995 | Pick | 68/207 |
| 5,984,194 A | | 11/1999 | Francalanci | 236/12.12 |
| 6,634,048 B1 | * | 10/2003 | Hornung et al. | 8/158 |

* cited by examiner

*Primary Examiner*—Frankie L. Stinson
*Assistant Examiner*—Joseph L. Perrin
(74) *Attorney, Agent, or Firm*—McKee, Voorhees & Sease, P.L.C.

(57) ABSTRACT

A high efficiency water valve member for a washing appliance includes a hot water valve, a cold water valve, and a low cold water valve. Associated with the hot water valve, the cold water valve, and the low cold water valve are a hot prime mover, a cold prime mover, and a low cold prime mover. These prime movers move their respective valves between their open and closed positions. When filling for a hot wash the hot prime mover and the low cold prime mover are energized to open the hot water valve and the low cold water valve. The cold water valve remains closed. For warm washes all three solenoids are activated to open all three valves. For cold washes the cold prime mover and the low cold prime mover are energized either together or alone to open either or both of the cold water valve and the low cold water valve.

6 Claims, 3 Drawing Sheets

*INLET TEMPERATURES PER STANDARD TESTING :*
*COLD: 60°F*
*HOT: 135°F*

| | HOT WATER VALVE 28 | COLD WATER VALVE 32 | LOW COLD WATER VALVE 36 | OUTLET TEMPS |
|---|---|---|---|---|
| HOT WATER | ON | OFF | ON | 115° - 120°F. |
| WARM WATER | ON | ON | ON | 75° - 82.5°F. |
| COLD WATER | OFF | ON | ON | 60°F. |
| FLOW RATE RATIOS | 1 | 2.08 - 3.64 | .25 - .36 | |

Fig. 3

HIGH EFFICIENCY WATER VALVE FOR WASHING APPLIANCE

BACKGROUND OF THE INVENTION

This invention relates to a high efficiency water valve for washing appliances.

Currently many washing machines use highly complicated electrical controls for controlling and changing the temperatures of the water within the washing appliance. This expensive and complicated electronic equipment is currently necessary in order to achieve high efficiency ratings for the appliance from the standpoint of water consumption and energy consumption.

Therefore, a primary object of the present invention is the provision of an improved apparatus and method for achieving high efficiency ratings on a clothes washer without utilizing expensive and complicated electronic equipment.

A further object of the present invention is the provision of an improved method and apparatus for delivering water of varying temperatures to a washing machine which achieves a high energy efficiency and a low water consumption.

A further object of the present invention is the provision of a high efficiency water control valve which comprises a three valve assembly designed with specific flow rates for each port in the ratios of 1.0 for the hot water valve, 2.08 to 3.64 for the first cold water valve, and 0.25 to 0.36 for the low cold water valve.

A further object of the present invention is the provision of a high efficiency water valve for washing appliance which achieves hot water temperatures of from 115° to 120° Fahrenheit, warm water temperatures from 75° to 82.5° Fahrenheit, and cold water temperatures approximately 60° or colder.

A further object of the present invention is the provision of a high efficiency water valve for washing appliance which adjusts water levels from 8.25 gallons for a minimum sized wash to 19 gallons for a maximum size wash.

A further object of the present invention is the provision of an improved high efficiency water valve for washing appliance which is efficient in operation, economical to manufacture, and durable in use.

BRIEF SUMMARY OF THE INVENTION

A water valve for introducing water of different temperatures into a washing appliance comprises a valve body having a hot water inlet and a cold water inlet adapted to be connected to separate sources of hot and cold water respectively. The valve body also includes an outlet. The valve body further includes a hot water valve, a cold water valve, and a low cold water valve. The hot water valve is movable from an open position for delivering hot water from the hot water inlet to the outlet to a closed position for preventing delivery of hot water from the hot water inlet to the outlet. The cold water valve is movable from an open position for delivering cold water from the cold water inlet to the outlet. The low cold water valve is movable from an open position for delivering cold water from the cold water inlet to the outlet at a second rate less than the first rate. It is also movable to a closed position preventing delivery of cold water from the cold water inlet to the outlet. Three prime movers including a hot prime mover, a cold prime mover and a low cold prime mover are connected to the hot, cold, and low cold water valves respectively. The prime movers independently move the hot, cold, and low cold water valves between their respective open and closed positions.

A controller is provided for actuating the hot, cold, and low cold prime movers independently of one another to selectively move the hot, cold and low cold valves to at least the following conditions:

A. The hot and low cold valves are in their open positions and the cold valve is in the closed position to cause a first temperature of water to exit from the outlet.

B. The hot, cold and low cold valves are all in their open positions to cause a second temperature of water lower than the first temperature to exit from the outlet.

C. The cold and low cold valves are in their open positions and the hot valve is in its closed position to cause a third temperature of water lower than the first and second temperatures to exit from the outlet.

Preferably the three prime movers may be solenoids, but other types of prime movers may be used without detracting from the invention.

The first temperature is preferably between 115° and 120° Fahrenheit. The second temperature is preferably between 75° and 82.5° Fahrenheit and the third temperature is preferably approximately 60° Fahrenheit.

The preferred ratios are respectively: 1.0 units for the hot valve, 2.08 to 3.64 units for the cold valve and 0.25 to 0.36 for the low cold valve.

BRIEF DESCRIPTION OF THE DRAWINGS

FIG. 3 is a table showing the various conditions of the three valves and showing the outlet temperatures achieved as well as the flow rates achieved with each valve.

DETAILED DESCRIPTION OF THE INVENTION

Figure 1:
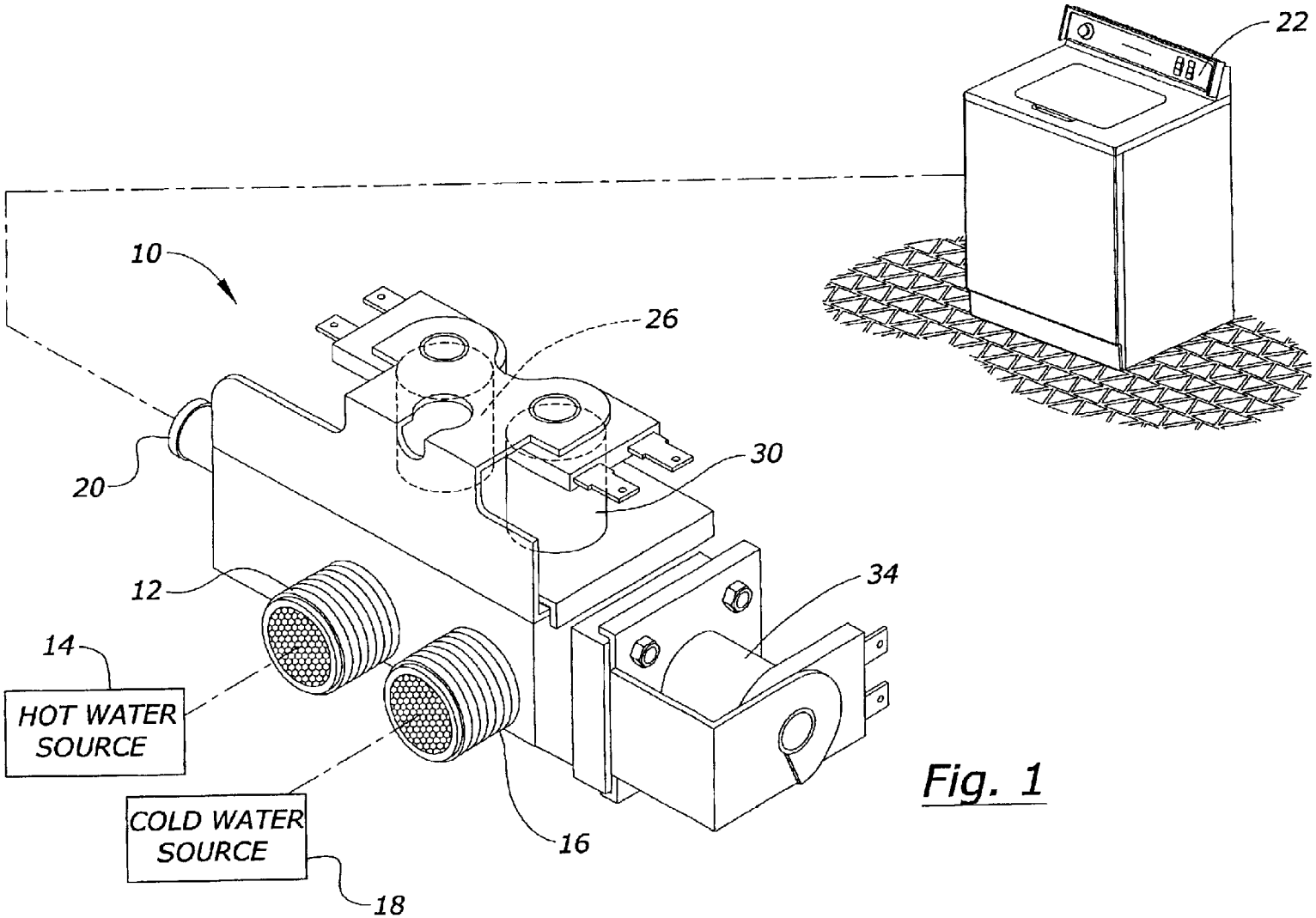
FIG. 1 is a partial perspective and partial schematic view of the valve used in the present invention.

Referring to the drawings the numeral 10 generally designates a water valve assembly used in the present invention. This valve assembly is manufactured by the Control Division of Eaton Corporation, Carol Stream, Ill. and is designated as an N-57 Valve.

Valve assembly 10 includes a hot water inlet 12 which is connected to a hot water source 14. Preferably the hot water source produces water of a temperature no greater than 135° Fahrenheit. Valve assembly 10 also includes a cold water inlet 16 which is connected to a cold water source 18 providing cold water at or about 60° Fahrenheit. The valve assembly 10 includes a water outlet 20 which is connected to a washing appliance 22, and specifically is adapted to provide water to a washing tub 24 within the washing appliance 22.

Figure 2:
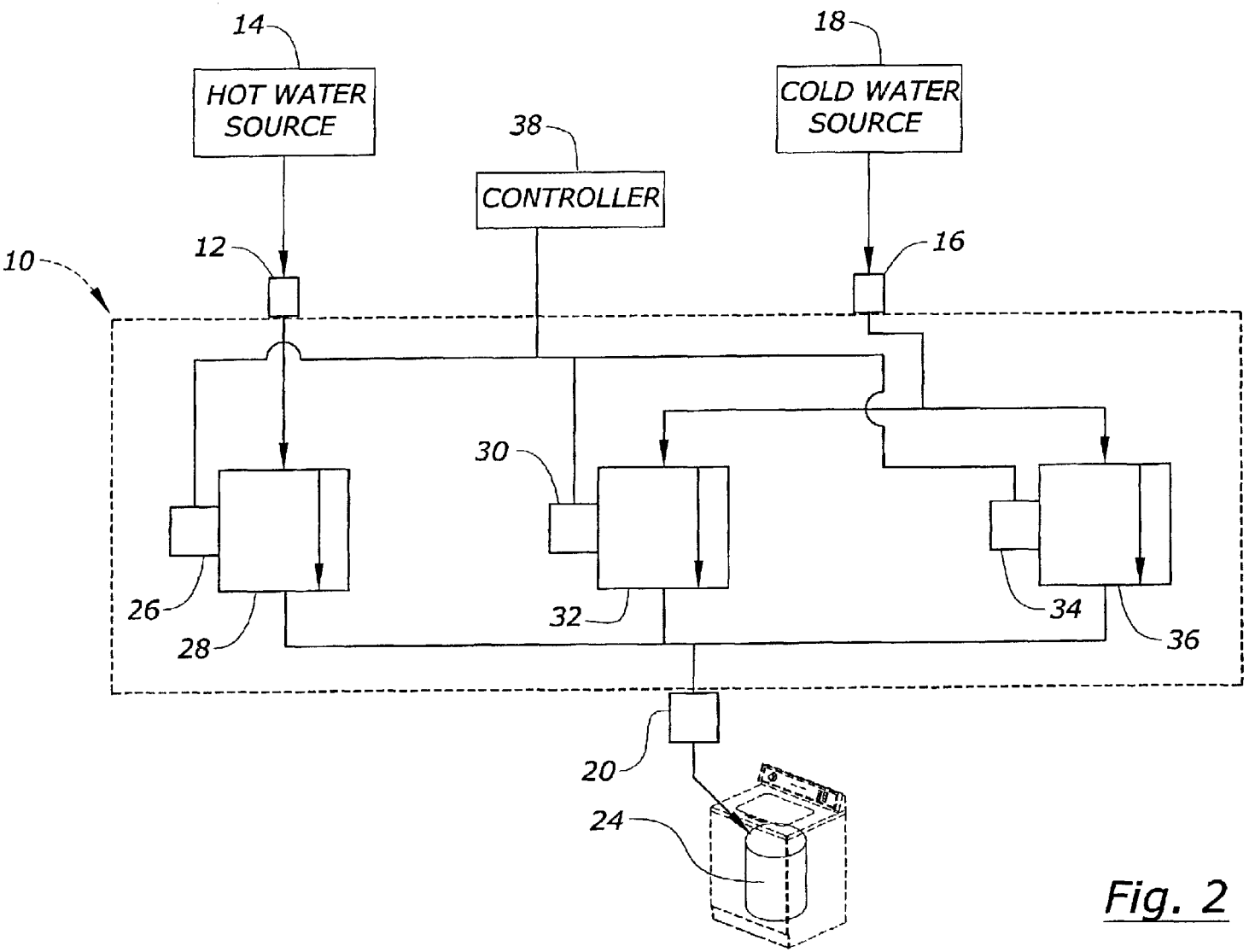
FIG. 2 is a-more detailed schematic view of the valve.

Valve assembly 10 includes a hot water solenoid 26 which is connected to a hot water valve 28 shown schematically in FIG. 2. Valve assembly 10 also includes a cold water solenoid 30 connected to a cold water valve 32, and a low cold water solenoid 34 connected to a low cold water valve 36.

Each of the valves 28, 32, 36 is movable from a closed position such as shown in FIG. 2 to an open position providing water flow to the outlet 20. The valve assembly 10 should be able to function within a pressure range of 30 to 100 PSI and should be capable of delivering 3.5 to 6.0 gallons per minute under those pressures. Assuming that the hot water source temperature is approximately 135° and the cold water source is approximately 60°, the conditions and results shown in the chart of FIG. 3 can be achieved. A hot water temperature of 115° to 120° Fahrenheit can be achieved by having the hot water valve 28 in its on position, the cold water valve 32 in its off position, and the low cold water valve 36 in its on position. A warm water condition of approximately 75° to 82.5° Fahrenheit can be achieved by having all three valves 28, 32, 36 in their on position. A cold water condition can be achieved by having the hot water valve 28 in its closed position and having the cold water valve 32 and the low cold water valve 36 in their open positions.

The chart of FIG. 3 also shows the flow rate ratios between the hot water valve 28, the cold water valve 32, and the low cold water valve 36. This ratio is 1 for the hot water valve 28, 2.08 to 3.64 for the cold water valve 32, and 0.25 to 0.36 for the low cold water valve 36. An electrical controller 38 is connected to each of the three solenoids 26, 30, 34 for selectively energizing various combinations of those solenoids to achieve the results shown in FIG. 3.

It has been found that the use of the above valve in a top loading washing machine can achieve a maximum wash water level of 19 gallons and a minimum wash level of 8.25 gallons, and can achieve an energy efficiency and water consumption efficiency which meets industry standards for high efficiency washing machines. This is achieved with a simple three way valve system having a simple electronic controller as contrasted with the highly complicated and expensive electronic controls that are required in prior art systems.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A water valve for introducing water of different temperatures to a washing appliance, comprising:

a valve body having a hot water inlet and a cold water inlet adapted to be connected to separate sources of hot and cold water respectively;

said valve body having an outlet;

said valve body having a hot water valve, a cold water valve, and a low cold water valve said hot water valve being movable from an open position for dalivering hot water from said hot water inlet to said rnltlet to a closed position for preventing delivezy of hot water from said hot water inlet to said outlet;

said cold water valve being movable from an open position for delivering cold water from said cold water inlet to said outlet at a first rate to a closed position preventing dalivery of cold water from said cold water inlet to said outlet;

said low cold water valve being movable from an open position for delivering cold water from said cold water inlet to said outlet at a second rate less than said first rate to a closed position preventing delivery of cold water from said cold water inlet to said outlet;

a hot prime mover, a cold prime mover, and a low cold prime mover connected to said hot, cold, and low cold water vklves respectively for independently moving said hot, cold, and low cold water valves between their respective open and closed positions;

a controller for actuating said hot, cold, and low cold prime movers independently of one another to selectively move move hot, cold, and low cold valves to at least the following conditions:

a. said hot and low cold valves being in said open positions and said cold valve being in said closed position to cause a first temjierature of water to exit from said outlet;

b. said hot, cold and low cold valves all being in said open position to cause a second temperature of water lower than said first temperature to exit from said outlet;

c. said cold and low cold valves being in said open positions and said hot valve being in said closed position to cause a third temperature of water lower than said first and second temperatures to exit from said outlet;

said hot valve, said cold valve, and said low cold valve have flow rates in the following ratios: 1.0 units for said hot valve, 2.08 to 3.64 units for said cold valve and 0.25 to 0.36 units for said low cold valve.

2. A water valve according to claim 1 wherein said hot prime mover, said cold prime mover, and said low cold prime mover comprise solenoids.

3. A water valve according to claim 1 wherein said hot water source is connected to hot water at up to 135 degrees F and said cold water source is connected to cold water at about 60 degrees F, said first temperature is between 115 and 120 degrees F, said second temperature is between 75 and 82.5 degrees F, and said third temperature is approximately 60 degrees F.

4. A device for delivering water of different temperatures to a washing appliance, said devpce comprising:

a valve assembly comprising a hot water inlet, a cold water inlet, a water outlet, a hot water valve between said hot water inlet and said water outlet, a first cold water valve between said cold water inlet and said water outlet, and a second cold water valve between said cold water inlet and said water outlet;

a first source of hot water at up to 135 degrees F. connected to the hot water inlet;

a second source of cold water at aDDroximatelv 60 degrees F. connected to the cold water inlet;

said hot water valve being movable from a closed position preventing the passage of the hot water from said hot water inlet to said water outlet to an open position permitting the passage of the hot water from said hot water inlet to said water outlet at a first flow rate;

said first cold water valve being movable from a closed position preventing passage of the cold water from said cold water inlet to said water outlet to an open position permitting the cold water to flow from said cold water inlet to said water outlet at a second flow rate;

said second cold water valve being movable from a closed position preventing passage of the cold water from said cold water inlet to said water outlet to an open position permitting the cold water to flow from said cold water inlet to said water outlet at a third flow rate less than said second flow rate;

a control system connected to said hot water valve, said first cold water valve, and said second cold water valve for causing the following conditions:

a. a hot water condition wherein said hot water valve and said first cold water valve are in said open positions and said second cold water valve is in said closed position;

b. a warm water condition wherein all of said hot water valve, said first cold water valve, and said second cold water valve are in said open positions;

c. a cold water condition wherein said hot water valve is in said closed position and one or both of said first and second cold water valves are in said open position;

said hot valve, said cold valve and said low cold valve having flow rate ratios relative to one another that cause said first temperature to be between 115 and 120 degrees F. said second temperature to be between 75 and 100 degrees F, and said third temperature to be approximately 60 degrees F, wherein said hot valve, said cold valve, and said low cold valve have flow rates in the following ratios: 1.0 units for said hot valve, 2.08 to 3.64 units for said cold valve and 0.25 to 0.36 units for said low cold valve.

5. A device according to claim 4 and further comprising a washing tub connected to said water outlet for receiving water therefrom.

6. A device according to claim 5 wherein said washing tub is part of a clothes washing machine.

* * * * *